United States Patent [19]

Stiffler et al.

[11] Patent Number: 4,911,503

[45] Date of Patent: Mar. 27, 1990

[54] EARTH ENGAGING CUTTER BIT

[75] Inventors: Stephen P. Stiffler, New Enterprise; Wayne H. Beach, Roaring Spring, both of Pa.

[73] Assignee: Kennametal Inc., Latrobe, Pa.

[21] Appl. No.: 221,839

[22] Filed: Jul. 20, 1988

[51] Int. Cl.[4] ..... F21C 35/18

[52] U.S. Cl. ..... 299/79; 175/411; 299/86

[58] Field of Search ..... 299/79, 86, 91; 175/409, 410, 411, 374, 375; 76/101 E, 108 R, 108 A, DIG. 5, DIG. 11; 407/118; 172/745, 713; 51/309

[56] References Cited

U.S. PATENT DOCUMENTS

| | | | |
|---|---|---|---|
| 177,973 | 5/1976 | Trissler | 172/719 |
| 2,614,813 | 10/1952 | Shepherd | 175/410 |
| 2,628,072 | 2/1953 | Baker | 175/410 |
| 2,707,619 | 5/1955 | Andersson | 175/411 |
| 2,784,943 | 3/1957 | Bylund | 175/411 X |
| 3,519,309 | 7/1970 | Engle et al. | 299/86 |
| 4,150,728 | 4/1979 | Garner et al. | 175/374 |
| 4,176,725 | 12/1979 | Shields | 175/374 |
| 4,190,127 | 2/1980 | Wolf | 175/410 |
| 4,201,421 | 5/1980 | Den Besten et al. | 299/86 |
| 4,216,832 | 8/1980 | Stephenson et al. | 172/540 |
| 4,497,520 | 2/1985 | Ojanen | 299/86 |
| 4,547,020 | 10/1985 | Ojanen | 299/86 |

FOREIGN PATENT DOCUMENTS

| | | | |
|---|---|---|---|
| 0122893 | 10/1984 | European Pat. Off. . | |
| 2846744 | 4/1980 | Fed. Rep. of Germany | 299/86 |
| 829343 | 12/1982 | South Africa . | |
| 8400269 | 12/1984 | Sweden | 299/86 |
| 402655 | 4/1974 | U.S.S.R. | 299/91 |
| 751991 | 7/1980 | U.S.S.R. | 299/86 |
| 781341 | 11/1980 | U.S.S.R. | 299/91 |
| 372252 | 5/1932 | United Kingdom . | |
| 1089611 | 11/1967 | United Kingdom | 299/79 |

OTHER PUBLICATIONS

Kennametal Inc. Drawing Nos. 285-9187 (1969) and 082-8890A (1969).

Handy and Harman Technical Data Sheet No. D-74 (1984).

Designing with Kennametal (1957) pp. 6-19.

Designing with Kennametal (1980) pp. 28-39.

*Primary Examiner*—Bruce M. Kisliuk

*Assistant Examiner*—David J. Bagnell

*Attorney, Agent, or Firm*—John J. Prizzi

[57] ABSTRACT

A cutter bit for use in construction and/or excavation applications is provided having a hard wear resistant tip joined to a steel shank. The wear resistant tip is rotational symmetric about its longitudinal axis and has a rear end having a socket therein in which is bonded a steel protrusion on the forward end of the steel shank.

28 Claims, 2 Drawing Sheets

FIG. 2
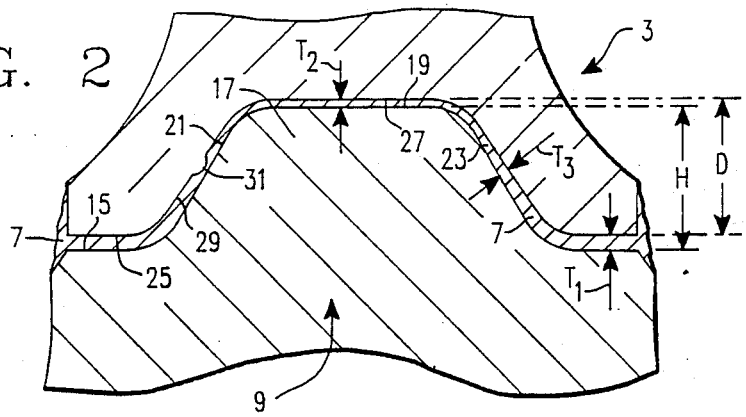
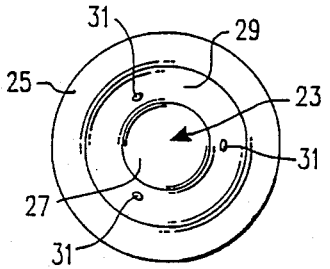
FIG. 3
FIG. 4
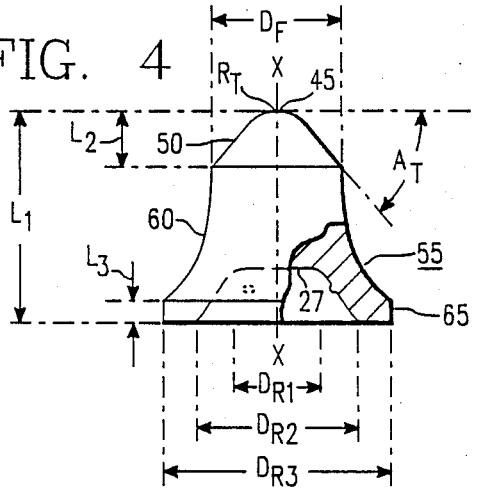
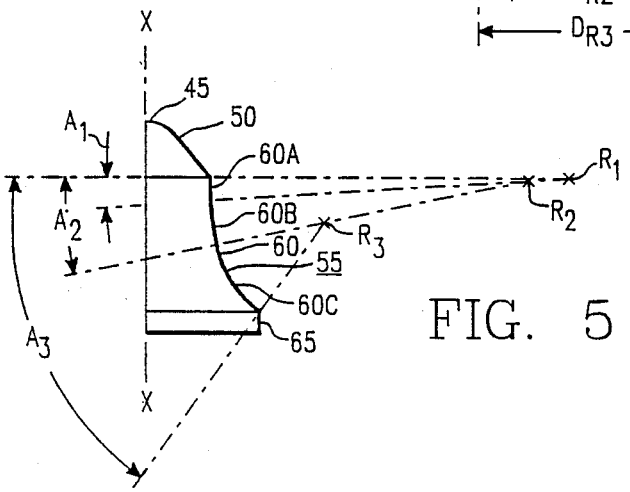
FIG. 5

EARTH ENGAGING CUTTER BIT

BACKGROUND OF THE INVENTION

The present invention relates to a cutter bit design for use in construction and excavation. It especially relates to cutter bits having a cemented carbide tip thereon.

In the past, a variety of cutter bit designs has been used in construction and excavation applications. These cutter bits have typically been tipped with a cemented tungsten carbide-cobalt insert which was brazed to the steel shank of the cutter bit.

Both rotatable and nonrotatable bits have been used in these applications. One of the early rotatable cutter bit designs involved a cemented carbide tip having an annular rear surface with a socket therein to which the forward end of the steel shank was brazed. The forward end of the steel shank had an annular forward surface with a forward projection thereon which partially extended into the socket (i.e., the depth of the socket was greater than the height of the forward projection). The braze joint between the steel and the cemented carbide was thus thickest at the forward end of the steel projection and thinnest at the facing annular surfaces of the cemented carbide and steel. While rotatable cutter bits of the foregoing design were commercially used, the cemented carbide of the tip was susceptible to fracture during usage.

The foregoing design was superseded by rotatable cutter bit designs in which the rear of the carbide was flat, or had a so-called valve seat design, either of which was brazed into a socket in the forward end of the steel (see, for example, U.S. Pat. Nos. 4,497,520 and 4,216,832, and West German Offenlegungschrift No. 2846744).

Examples of cutter bit designs utilizing a socket in the rear of the carbide are shown in South African Patent No. 82/9343; Russian Inventor's Certificate No. 402655; Published Swedish patent application No. 8400269-0 and U.S. Pat. No. 4,547,020.

SUMMARY OF THE INVENTION

The present applicants have designed an improved cutter bit including a cemented carbide tip brazed to its forward end, in which the carbide tip has a socket in which a ferrous (e.g., steel) projection on the forward end of the steel shank or body is received. The design according to the present invention is believed to offer a combination of improved carbide fracture resistance in conjunction with an improved joint strength between the carbide and the steel.

In accordance with the present invention, an improved cutter bit is provided having a ferrous body bonded to a cemented carbide tip. The ferrous body has a longitudinal axis and a forward end. The forward end has a first forwardly facing surface and a second forwardly facing surface in which the second forwardly facing surface is located radially inside of the first forward surface, as well as being located forward of said first forwardly facing surface by a distance, H.

The cemented carbide tip has a first rearwardly facing surface with a socket therein extending forwardly therefrom and having a second rearwardly facing surface located a distance, D, from the first rearwardly facing surface. The distances, H and D, have been sized such that H is greater than D. In addition, the first rearwardly facing surface of the tip is bonded to the first forwardly facing surface of the ferrous body, while the second rearwardly facing surface of the tip is bonded to the second forwardly facing surface of the ferrous body.

In this manner, the bond, or joint, between the carbide and steel, which is preferably provided by brazing, is thicker between the first rearwardly facing surface of the carbide and the first forwardly facing surface of the steel, than that found between the second rearwardly facing surface of the carbide and the second forwardly facing surface of the steel.

These and other aspects of the present invention will become more apparent upon review of the drawings, which are briefly described below in conjunction with the detailed description of the invention.

BRIEF DESCRIPTION OF THE DRAWINGS

FIG. 2 shows an enlarged view of the braze joint shown in cross section in FIG. 1.

FIG. 3 shows a rear plan view of the rear end of the embodiment of the tip shown in FIGS. 1 and 2.

FIG. 4 shows a plan view of an embodiment of a tip in partial cross section.

FIG. 5 shows half a plan view of the embodiment of the tip shown in FIG. 4.

DETAILED DESCRIPTION OF THE INVENTION

Figure 1:
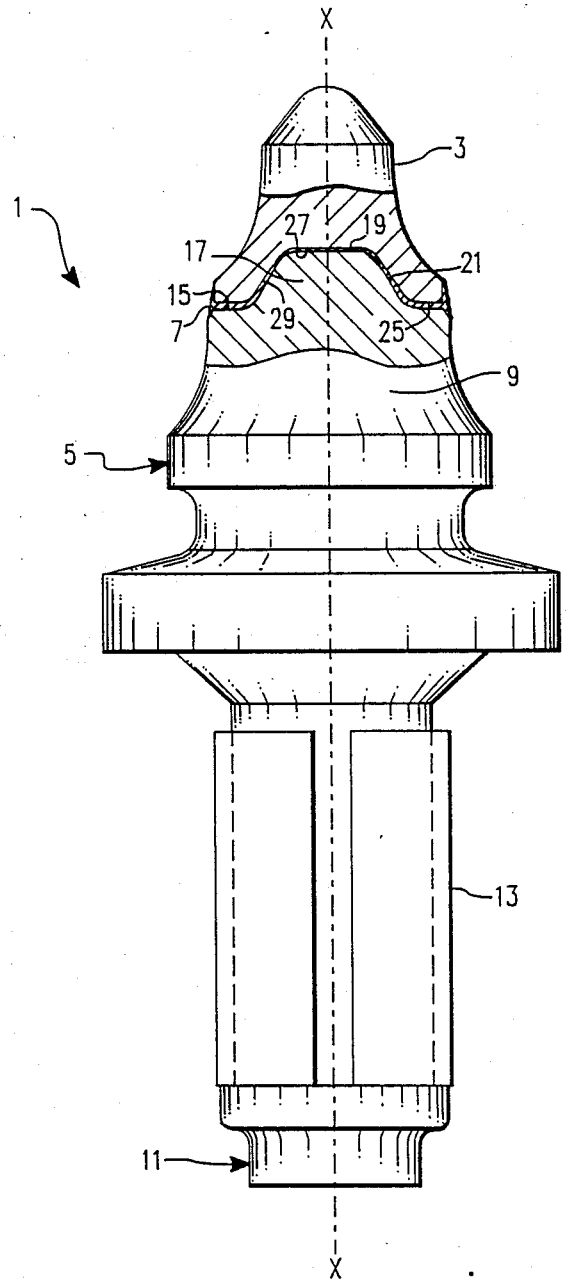
FIG. 1 shows a plan view of a preferred embodiment of an cutter bit in accordance with the present invention in partial cross section.

Shown in FIG. 1 is a preferred embodiment of rotatable cutter bit 1 having a cemented tungsten carbide-cobalt tip 3 joined to a ferrous metal body 5, here steel, by a braze joint 7. The steel body 5 extends along and is preferably rotationally symmetric about a longitudinal axis X—X which extends between the forward end 9 and rearward end 11 of the body 5. The rearward end 11 of the steel body 5 may have loosely retained thereon a resilient retainer member 13 for releasably holding the cutter bit rotatable in the bore of a mounting block on a conventional construction or excavating machine (not shown). This and other styles of resilient retainer means useful with the present invention are described in U.S. Pat. Nos. 3,519,309 and 4,201,421.

The forward end 9 of the ferrous body 5 has a first annular forwardly facing surface 15 which preferably lies in a plane perpendicular to the longitudinal axis. Radially inside of this first forwardly facing surface 15 is a protrusion 17 extending forwardly therefrom. At the forward end of the protrusion 17 is a second forwardly facing surface 19 which preferably lies in a plane perpendicular to the longitudinal axis. The first and second forwardly facing surfaces are joined by a surface which tapers inwardly as it extends forwardly, preferably a frustoconical surface 21, which is rotationally symmetric about longitudinal axis X—X. All sharp inside and outside corners preferably are removed and replaced by fillets or chamfers.

The height, H, of the second surface 19 above the first surface 15 is preferably about 0.178 to 0.188 inch. More importantly, the height, H, is greater than the depth, D, of a generally complementary shaped socket 23 in the cemented tungsten carbide-cobalt tip 3 so that when the protrusion 17 is brazed to the socket 23 the thickness of the resultant braze joint will be smaller adjacent the second forwardly facing surface 19 than it is adjacent the annular forwardly facing surface 15.

In FIG. 2, the foregoing is shown more clearly. The cemented carbide tip 3 has an annular rearmost surface 25 facing the forward end 9 of the steel body, and more particularly, facing the annular forwardly facing surface 15 on the steel body. Located radially inside of, and forward of, annular rearward facing surface 25 is a second rearwardly facing surface 27. Both surfaces 25 and 27 are preferably planar in nature and preferably lie in a plane perpendicular to longitudinal axis X—X. Preferably located between, and preferably joining, the two rearwardly facing surfaces 25 and 27 is an inwardly facing surface 29 extending forwardly from the annular rearmost surface 25 while tapering inwardly. The depth, D, of the socket 23 defined by surfaces 27 and 29 is preferably between about 0.170 to about 0.176 inch, but more importantly, the depth, D, of the socket is less than the height, H. The socket and protrusion have been sized such that, in the absence of braze metal, the tip can be seated on the surface 19 of the steel body without touching surface 15 of the steel body.

This results in a braze joint 7 which has an average thickness, $T_1$, between the annular rearwardly facing surface 25 of the tip and the annular forwardly facing surface 15 of the steel body which is greater than the average thickness, $T_2$, between rearwardly facing surface 27 of the tip and forwardly facing surface 19 of the ferrous body. Thickness, $T_1$, is preferably between about 0.008 to 0.024 inch, and more preferably, between about 0.010 to 0.016 inch thick. Thickness, $T_2$, is preferably between about 0.001 to 0.006 inch, and more preferably, between about 0.002 to 0.004 inch thick. The preferred average braze joint thickness, $T_3$, between the inwardly tapering surfaces 29 and 21 on the tip socket and the steel body protrusion 17 are also between about 0.008 to 0.024 inch, and more preferably, between about 0.010 and 0.016 inch. Preferably, $T_1$ and $T_3$ are each at least twice $T_2$ and, more preferably, at least three times $T_2$. In order to substantially maintain the uniformity of the braze joint thickness, $T_3$, around the circumference of the protrusion surface 17, it is preferred that a centering means be located between the inwardly tapering surface 29 of the tip socket and the tapering surface 21 on the protrusion. This centering means is preferably a part of the tip and preferably takes the form of bumps 31 extending radially inwardly from the inwardly tapering surface 29 of the tip socket and are circumferentially distributed on this surface. Preferably, there are three bumps 31 located at 120 degrees to each other. These are more clearly shown in the FIG. 3 rear plan view of the tip.

The size of the bumps 31 should be such that, while they assist in assuring substantial uniformity of the braze thickness, $T_3$, they are not so large so as to interfere with the maintenance of the requirement that $T_2$ is less than $T_3$. Spherical shape bumps having a height of about 0.005 to 0.008 inches above surface 29 are suitable for this purpose. By assuring that the foregoing relation exists between $T_2$ and $T_3$, it is believed that tip fracture in use will be minimized while providing a strong, long-lived joint between the tip of the steel body, thereby minimizing tip loss.

In an alternative embodiment (not shown), the annular surfaces 25 and 15 on the tip and steel shank, respectively, may be tilted rearwardly as they extend radially outwardly from the longitudinal axis X—X to thereby form frustoconical surfaces. In such a case, the angle of tilt is less than that of surfaces 21 and 29 and is preferably no greater than 30 degrees from a plane perpendicular to the longitudinal axis X—X. In this embodiment, the depth, D, may be calculated from a plane defined by the rearmost edge of surface 25 which occurs where it meets cylindrical surface 65 (see FIG. 4). To be consistent, the height, H, of the steel protrusion in this situation would be calculated from a plane defined by where surface 15 intersects diameter $D_{R3}$, the outer diameter of tip surface 65 (see FIG. 4).

It is further preferred that a high temperature braze material be used in joining the tip to the ferrous body so that braze joint strength is maintained over a wide temperature range. Preferred braze materials are Handy Hi-temp® 548, Trimet® 549, 080 and 655. Most preferred are the 548 and 549 braze materials. Handy Hi-temp®-548 alloy is composed of 55 ±1.0 w/o (weight percent) Cu, 6±0.5 w/o Ni, 4±0.5 w/o Mn, 0.15±0.05 w/o Si, with the balance zinc and 0.50 w/o maximum total impurities. The Handy Hi-temp®-Trimet® 549 is a 1-2-1 ratio Trimet® clad strip of Handy Hi-temp® 548 on both sides of copper. Further information on Handy Hi-temp® 548 and Trimet® 549 can be found in Handy & Harman Technical Data Sheet Number D-74. The foregoing braze alloys are manufactured and sold by Handy & Harman Inc., 859 Third Avenue, New York, N.Y. 10022. Handy Hi-temp and Trimet are registered trademarks of Handy & Harman Inc.

Applicants have found that acceptable braze joints have been achieved by using Handy Hi-temp®-549 discs which have been shaped into cups, fitted between the socket of the tip and the protrusion of the ferrous body and then brazed by conventional induction brazing techniques which, in addition to brazing the tip to the steel body, also hardens the steel which may be any of the standard steels used for rotatable cutter bit bodies. After the brazing and hardening step, the steel is tempered to a hardness of Rockwell C 40-45. The cemented carbide tip may be composed of any of the standard tungsten carbide-cobalt compositions conventionally used for construction and excavation applications. Applicants have found that acceptable results in asphalt reclamation have been achieved with a standard tungsten carbide grade containing about 5.7 w/o cobalt and having a Rockwell A hardness of about 88.2.

The earth engaging surfaces of the tip may have any of the conventional sizes or shapes previously used in the art. However, a preferred design is shown in FIGS. 1–5. In the design shown, the forward end of the earth engaging surfaces has a spherical nose 45 having a radius $R_T$, joined to a frustoconical surface 50 tapering away from the rotational axis of symmetry, X—X, as it extends rearwardly at an angle 90-$A_T$, to form a maximum diameter, $D_F$ at a distance $L_2$ from the forward end of nose 45. Joined to frustoconical surface 50 is a bell shaped section 55 having an earth engaging concave surface 60 at whose rear end is joined a uniform diameter protective surface 65. The concave surface is formed by a series of concave surfaces 60A, 60B and 60C, each having a different radius of curvature and wherein the radii decrease as one moves rearwardly along the length of the tip (i.e., 60A>60B>60C). While any number of radii, $R_N$, or arcs, $A_N$, may be used, it is preferred that at least three radii (or arcs) be used to form the smooth continuous surface 60, here shown as $R_1$, $R_2$ and $R_3$, and $A_1$, $A_2$ and $A_3$. The rear end of the concave surface 60 joins cylindrical surface 65 which preferably has a diameter $D_{R3}$ which is not only greater than $D_F$, but is of sufficient size to completely, or at least substantially cover the entire forward surface of the steel body to which the tip is brazed (i.e., more than 98% of the forward surface diameter). Maximum protection from wear to the forward end of the steel shank is thereby provided by the cemented carbide tip, thus reducing the rate of wear on the forward end 9 of steel body.

The use of the concave surface 60 of variable radius as shown allows a tip to be manufactured having increased length $L_1$ while assuring maximum strength and a substantially even distribution of stresses during use to thereby minimize tip fracture in use.

The internal diameters of the socket $D_{R1}$ and $D_{R2}$, and its shape, can be selected to provide a substantially uniform wall surface, especially in the zone of the concave section 60. The flat circular surface 27 at the forward end of the socket provides a large area for brazing to the forward end surface of the protrusion on the steel body. This structure, in combination with the thin braze joint thickness at this location, provides assurance that, during use, most significant loads applied to the tip will place the tip in compression rather than tension. Examples of dimensions which applicants have found to be acceptable are shown in Table I. These dimensions should be use with the previously provided dimensions relating to the tip socket, steel protrusion and braze joint thicknesses.

TABLE I

EXEMPLARY TIP DIMENSIONS

| Attribute | Radius (inch) | Diameter (inch) | Angle (degree) | Length (inch) |
|---|---|---|---|---|
| $R_1$ | 1.179 | | | |
| $R_2$ | 1.047 | | | |
| $R_3$ | 0.363 | | | |
| $A_1$ | | | 3.708 | |
| $A_2$ | | | 11.630 | |
| $A_3$ | | | 53.672 | |
| $R_T$ | 0.125 | | | |
| $A_T$ | — | | 50 | |
| $L_1$ | | | | 0.693 |
| $L_2$ | | | | 0.184 |
| $L_3$ | | | | 0.070 |
| $D_F$ | | 0.425 | | |
| $D_{R1}$ | | 0.285 | | |
| $D_{R2}$ | | 0.531 | | |
| $D_{R3}$ | | 0.750 | | |

All patents and documents referred to herein are hereby incorporated by reference.

As is well known to those of ordinary skill in the art, at the junctures of the various surfaces described on the carbide tip, chamfers, fillets and/or pressing flats may be provided, where appropriate, to assist in manufacturing and/or provide added strength to the structure.

Other embodiments of the invention will be apparent to those skilled in the art from a consideration of this specification or practice of the invention disclosed herein. It is intended that the specification and examples be considered as exemplary only, with the true scope and spirit of the invention being indicated by the following claims.

What is claimed is:

1. A cutter bit for engaging earth comprising:

a ferrous body having a longitudinal axis and a forward end;

a cemented carbide tip rotationally symmetric about said longitudinal axis;

said cemented carbide tip having:

a rounded foremost earth engaging surface;

a second earth engaging surface which extends radially outwardly while extending rearwardly of said rounded foremost earth engaging surface;

an annular rearmost surface facing said forward end of said ferrous body and oriented in a first plane perpendicular to said longitudinal axis;

an inwardly facing surface extending forwardly from said annular rearmost surface while tapering inwardly;

and a rearwardly facing surface located radially within said inwardly facing surface and forwardly of said annular rearmost surface;

a braze joint joining said rearwardly facing surface, said inwardly facing surface and said annular rearmost surface to said forward end of said ferrous body;

and wherein said braze joint has an average thickness adjacent said rearwardly facing surface which is smaller than the average thickness of said braze joint adjacent said annular rearmost surface.

2. The cutter bit according to claim 1 wherein said rearwardly facing surface is planar and oriented in a second plane perpendicular to said longitudinal axis.

3. The cutter bit according to claim 2 wherein the average thickness of said braze joint adjacent said annular rearmost surface is at least twice the average thickness of said braze joint adjacent said rearwardly facing surface.

4. The cutter bit according to claim 2 wherein the average thickness of said braze joint adjacent said annular rearmost surface is at least three times the average thickness of said braze joint, adjacent said rearwardly facing surface.

5. The cutter bit according to claim 1 wherein the average thickness of said braze joint adjacent said annular rearmost surface is at least twice the average thickness of said braze joint adjacent said rearwardly facing surface.

6. The cutter bit according to claim 1 wherein the average thickness of said braze joint adjacent said annular rearmost surface is at least three times the average thickness of said braze joint adjacent said rearwardly facing surface.

7. A cutter bit for engaging earth comprising:

a ferrous metal body having a longitudinal axis and a forward end;

a cemented carbide tip for engaging said earth;

wherein said cemented carbide tip being rotationally symmetric about said longitudinal axis and having:

an annular rearmost surface facing said forward end of said ferrous body;

an inwardly facing surface extending forwardly from said annular rearmost surface while tapering inwardly;

and a rearwardly facing surface located radially inwardly of said inwardly facing surface and forwardly of said annular rearmost surface;

a braze joint joining said rearwardly facing surface, said inwardly facing surface and said annular rearmost face to said forward end of said ferrous body;

and wherein said braze joint has an average thickness adjacent said rearwardly facing surface which is smaller than the average thickness of said braze joint adjacent said annular rearmost surface.

8. The cutter bit according to claim 7 wherein said rearwardly facing surface is planar and oriented in a plane perpendicular to said longitudinal axis.

9. The cutter bit according to claim 8 wherein the average thickness of said braze joint adjacent said annular rearmost surface is at least twice the average thickness of said braze joint adjacent said rearwardly facing surface.

10. The cutter bit according to claim 8 wherein the average thickness of said braze joint adjacent said annular rearmost surface is at least three times the average thickness of said braze joint adjacent said rearwardly facing surface.

11. The cutter bit according to claim 7 wherein the average thickness of said braze joint adjacent said annular rearmost surface is at least twice the average thickness of said braze joint adjacent said rearwardly facing surface.

12. The cutter bit according to claim 7 wherein the average thickness of said braze joint adjacent said annular rearmost surface is at least three times the average thickness of said braze joint adjacent said rearwardly facing surface.

13. A cutter bit for engaging earth comprising:

a ferrous body having a longitudinal axis and a forward end;

a cemented carbide tip for engaging said earth;

wherein said cemented carbide tip being rotationally symmetric about said longitudinal axis and having:

a first rearwardly facing surface with a socket therein extending forwardly therefrom and having a second rearwardly facing surface located a distance, D, from said first rearwardly facing surface;

said forward end of said ferrous body having a first forwardly facing surface and a second forwardly facing surface;

wherein said second forwardly facing surface is radially inside of said first forwardly facing surface and located forward of said first forwardly facing surface by a distance, H;

wherein said first rearwardly facing surface of said cemented carbide tip is bonded to said first forwardly facing surface of said ferrous body and said second rearwardly facing surface of said cemented carbide tip is bonded to said second forwardly facing surface of said ferrous body;

and wherein H is greater than D.

14. The cutter bit according to claim 13 wherein said second rearwardly facing surface is planar and wherein said second forwardly facing surface is planar.

15. A cutter bit for use in asphalt reclamation comprising:

a ferrous body having a longitudinal axis and a forward end;

a cemented carbide tip rotationally symmetric about said longitudinal axis;

said cemented carbide tip having:

a rounded foremost asphalt engaging surface;

a second asphalt engaging surface which extends radially outwardly while extending rearwardly of said rounded foremost asphalt engaging surface;

an annular rearmost surface facing said forward end of said ferrous body and oriented in a first plane perpendicular to said longitudinal axis;

an inwardly facing surface extending forwardly from said annular rearmost surface while tapering inwardly;

and a rearwardly facing surface located radially within said inwardly facing surface and forwardly of said annular surface;

a braze joint joining said rearwardly facing surface, said inwardly facing surface and said annular rearmost surface to said forward end of said ferrous body;

wherein said braze joint has an average thickness adjacent said rearwardly facing surface which is smaller than the average thickness of said braze joint adjacent said annular rearmost surface;

and a resilient retainer means for holding said cutter bit rotatable about said longitudinal axis in a mounting block, said resilient retainer means loosely retained on said ferrous body.

16. The cutter bit according to claim 15 wherein said rearwardly facing surface is planar and oriented in a second plane perpendicular to said longitudinal axis.

17. The cutter bit according to claim 16 wherein the average thickness of said braze joint adjacent said annular rearmost surface is at least twice the average thickness of said braze joint adjacent said rearwardly facing surface.

18. The cutter bit according to claim 16 wherein the average thickness of said braze joint adjacent said annular rearmost surface is at least three times the average thickness of said braze joint adjacent said rearwardly facing surface.

19. The cutter bit according to claim 15 wherein the average thickness of said braze joint adjacent said annular rearmost surface is at least twice the average thickness of said braze joint adjacent said rearwardly facing surface.

20. The cutter bit according to claim 15 wherein the average thickness of said braze joint adjacent said annular rearmost surface is at least three times the average thickness of said braze joint adjacent said rearwardly facing surface.

21. A cutter bit for use in asphalt reclamation comprising:

a ferrous body having a longitudinal axis and a forward end;

a cemented carbide tip rotationally symmetric about said longitudinal axis;

said cemented carbide tip having:

a rounded foremost asphalt engaging surface;

a second asphalt engaging surface which extends radially outwardly while extending rearwardly of said rounded foremost asphalt engaging surface;

an annular rearmost surface facing said forward end of said ferrous body and oriented in a first plane perpendicular to said longitudinal axis;

an inwardly facing surface extending forwardly from said annular rearmost surface while tapering inwardly;

and a rearwardly facing surface located radially within said inwardly facing surface and at a distance, D, forwardly of said annular rearmost surface;

said forward end of said ferrous body having a first forwardly facing surface and a second forwardly facing surface;

wherein said second forwardly facing surface is radially inside of said first forwardly facing surface and located forward of said first forwardly facing surface by a distance, H;

wherein said annular rearmost surface of said cemented carbide tip is bonded to said first forwardly facing surface of said ferrous body and said rearwardly facing surface of said cemented carbide tip is bonded to said second forwardly facing surface of said ferrous body by a braze joint;

wherein H is greater than D;

wherein said braze joint has an average thickness adjacent said rearwardly facing surface which is smaller than the average thickness of said braze joint adjacent said annular rearmost surface;

and a resilient retainer means for holding said cutter bit rotatably about said longitudinal axis in a mounting block, said resilient retainer means loosely retained on said ferrous body.

22. The cutter bit according to claim 21 wherein said rearwardly facing surface is planar and oriented in a plane perpendicular to said longitudinal axis.

23. The cutter bit according to claim 22 wherein the average thickness of said braze joint adjacent said annular rearmost surface is at least twice the average thickness of said braze joint adjacent said rearwardly facing surface.

24. The cutter bit according to claim 22 wherein the average thickness of said braze joint adjacent said annular rearmost surface is at least three times the average thickness of said braze joint adjacent said rearwardly facing surface.

25. The cutter bit according to claim 21 wherein the average thickness of said braze joint adjacent said annular rearmost surface is at least twice the average thickness of said braze joint adjacent said rearwardly facing surface.

26. The cutter bit according to claim 21 wherein the average thickness of said braze joint adjacent said annular rearmost surface is at least three times the average thickness of said braze joint adjacent said rearwardly facing surface.

27. A cutter bit for engaging asphalt comprising:

a ferrous body having a longitudinal axis and a forward end;

a cemented carbide tip for engaging said asphalt;

wherein said cemented carbide tip being rotationally symmetric about said longitudinal axis and having:

a first rearwardly facing surface with a socket therein extending forwardly therefrom and having a second rearwardly facing surface located a distance, D, from said first rearwardly facing surface;

said forward end of said ferrous body having a first forwardly facing surface and a second forwardly facing surface;

wherein said second forwardly facing surface is radially inside of said first forwardly facing surface and located forward of said first forwardly facing surface by a distance, H;

wherein said first rearwardly facing surface of said cemented carbide tip is bonded to said first forwardly facing surface of said ferrous body and said second rearwardly facing surface of said cemented carbide tip is bonded to said second forwardly facing surface of said ferrous body;

and wherein H is greater than D;

and a resilient retainer means for holding said cutter bit rotatable about said longitudinal axis in a mounting block, said resilient retainer means loosely retained on said ferrous body.

28. The cutter bit according to claim 27 wherein said second rearwardly facing surface is planar and wherein said second forwardly facing surface is planar.

* * * * *